US010016072B2

(12) United States Patent
Goppion

(10) Patent No.: US 10,016,072 B2
(45) Date of Patent: Jul. 10, 2018

(54) DISPLAY SHOWCASE WITH REINFORCED SUPPORTING BEAM OF THE UPPER CEILING

(71) Applicant: GOPPION S.P.A., Trezzano Sul Naviglio (MI) (IT)

(72) Inventor: Alessandro Goppion, Milan (IT)

(73) Assignee: GOPPION S.P.A., Trezzano Sul Naviglio (IT)

( * ) Notice: Subject to any disclaimer, the term of this patent is extended or adjusted under 35 U.S.C. 154(b) by 0 days.

(21) Appl. No.: 15/117,428

(22) PCT Filed: May 20, 2016

(86) PCT No.: PCT/IB2016/052975
§ 371 (c)(1),
(2) Date: Aug. 8, 2016

(87) PCT Pub. No.: WO2016/185439
PCT Pub. Date: Nov. 24, 2016

(65) Prior Publication Data

US 2017/0251834 A1 Sep. 7, 2017

(30) Foreign Application Priority Data

May 20, 2015 (IT) ..... 10201516246

(51) Int. Cl.
*A47F 3/00* (2006.01)
*A47F 3/12* (2006.01)

(52) U.S. Cl.
CPC ..... *A47F 3/12* (2013.01); *A47F 3/005* (2013.01)

(58) Field of Classification Search
CPC ..... A47F 3/12; A47F 3/005
See application file for complete search history.

(56) References Cited

U.S. PATENT DOCUMENTS 910,148 A * 1/1909 Pope ..... A47F 3/005 312/114
1,158,768 A * 11/1915 Andrew ..... A47F 3/005 312/114

(Continued)

FOREIGN PATENT DOCUMENTS

DE 298 13 519 U1 10/1998
EP 2 559 359 A1 2/2012

(Continued)

OTHER PUBLICATIONS

International Search Report and Written Opinion for International application No. PCT/IB2016/052975 filed May 20, 2016, Applicant: Goppion S.P.A., dated Sep. 5, 2016.

(Continued)

*Primary Examiner* — Hanh V Tran
(74) *Attorney, Agent, or Firm* — Steinfl + Bruno LLP

(57) ABSTRACT

A display showcase includes a base, fixed side walls supported by the base, at least one openable side wall, an upper horizontal beam mounted at the openable side wall, an upper ceiling mounted on the fixed side walls and on the beam, and a beam, a longitudinal tubular element, two head groups abutted at opposite ends of the tubular element, a tie rod longitudinally extended in the tubular element in a lower region thereof, coupled to the two head groups and taut therebetween.

8 Claims, 2 Drawing Sheets

(56) References Cited

U.S. PATENT DOCUMENTS

| | | | | | |
|---|---|---|---|---|---|
| 1,230,825 | A * | 6/1917 | Arnold | A47F 3/005 | 312/114 |
| 1,966,928 | A * | 7/1934 | Friedel | A47B 47/024 | 108/64 |
| 2,501,980 | A * | 3/1950 | Wolfe | A01K 1/10 | 220/4.33 |
| 3,365,257 | A * | 1/1968 | Diack | A47F 3/12 | 312/140 |
| 3,494,686 | A * | 2/1970 | Diack | A47F 3/005 | 312/140 |
| 3,589,784 | A | 6/1971 | Winkels | | |
| 5,054,863 | A * | 10/1991 | Amstutz | A47F 3/005 | 312/108 |
| 5,234,267 | A * | 8/1993 | Pauer | A47B 47/00 | 248/244 |
| 9,445,668 | B2 * | 9/2016 | Bonuccelli | A47B 47/00 | |
| 2006/0290242 | A1 * | 12/2006 | Coval | A47F 3/001 | 312/114 |
| 2007/0007865 | A1 * | 1/2007 | Kang | A47F 3/005 | 312/114 |

FOREIGN PATENT DOCUMENTS

| | | | | |
|---|---|---|---|---|
| EP | 2 559 359 | A1 | 2/2013 | |
| NL | 7 406 874 | A | 11/1975 | |
| NL | 7406874 | A | 11/1975 | |
| WO | WO 2007102177 | A1 * | 9/2007 | E06B 3/9649 |

OTHER PUBLICATIONS

European Patent Office Search Report for Italian Application No. 102015000016246 (UB2015A000842), Date completed Jan. 26, 2016.

* cited by examiner

DISPLAY SHOWCASE WITH REINFORCED SUPPORTING BEAM OF THE UPPER CEILING

CROSS-REFERENCE TO RELATED APPLICATIONS

The present application is the U.S. National Stage of International Patent Application PCT/IB2016/052975 filed May 20, 2016 which, in turn, claims priority to Italian application 102015000016246 files on May 20, 2015 which is incorporated herein by reference in its entirety.

The present invention refers to a showcase, in particular a showcase for conserving and displaying objects in a protected environment, such as typically works of art, objects of cultural heritage or in any case delicate objects, in museums, exhibitions and the like. The present invention also refers to a beam intended to be used in the construction of a display showcase and to a method for making a display showcase.

Here and hereinafter the term protected environment is meant to indicate an environment in which the atmosphere is controlled, through the monitoring of one or more parameters including temperature, humidity, dust content, pollutant content, in order to maintain the foreseen conservation conditions of the displayed objects, and wherein it is made impossible for access to be granted to unauthorised people, to avoid theft or damage to the objects displayed.

Showcases of this type must therefore satisfy various kinds of requirements, in relation to the conservation and integrity of the objects displayed. Moreover, of course, these showcases must ensure the best visibility for the objects displayed.

In order to improve visibility indeed, showcase manufacturers try as much as possible to use transparent materials—typically glass—both for the walls and for the upper ceiling of the showcases. As well as ensuring the best visibility of the objects displayed, the extensive use of glass is often desired by designers of showcases because the transparency of the material allows the objects displayed to be given the maximum emphasis, making the visual impact of the structure of the showcase as low as possible, to the benefit of the cultural message transmitted by the objects contained in the showcase.

Therefore, showcases have been developed with a base topped with a case; the base houses all of the technical components necessary to ensure that the environment inside the case is protected and it is thus normally closed by non-transparent walls, which conceal all of the technical components from view; vice-versa, the walls of the case and the upper ceiling are made partially or entirely from glass, for the aforementioned reasons.

The possibility of access inside the case, for housing, removing or maintaining the objects displayed, is normally obtained by providing that at least one of the side walls is formed from an openable panel. For this purpose, opening supports of various kinds are used, which for example allow opening by rotation or roto-translation of the panel (more or less complex hinges) or by sliding (sliding guides).

The ceiling is generally mounted on the fixed side walls, glued or fixed in another way, and its weight discharges onto the fixed side walls. When the showcase is large, the weight of the ceiling can also be very high, such as to cause an inflection of the ceiling itself downwards, where the ceiling is not supported. In particular, at the openable wall, the inflection of the ceiling can make it difficult to correctly close the openable wall itself, preventing the closing of the showcase from being hermetic. In these cases, beams or reinforcing structures are used that pass over the openable wall, rest on the adjacent fixed walls and provide a support for the ceiling at the openable wall.

In order to limit as much as possible the visual impact of these reinforcing structures, which inevitably disturb the overall impact of the showcase by interfering with the cultural message transmitted by the objects displayed, it is thus attempted to limit as much as possible the size of the reinforcing structures and/or to make them in turn from transparent material (glass). In the first case, however, there is a risk of not providing a sufficient support for the ceiling and therefore of creating problems for the correct closing of the openable wall. In the second case, there is a risk of having a fragile structure, which can suddenly yield with disastrous consequences.

Therefore, there is the problem of adequately and safely supporting the ceiling of a showcase at an openable wall, also in the case in which the showcase is large, without however penalizing the visual impact of the showcase by interfering with the cultural message transmitted by the objects displayed.

This problem is solved, in accordance with different aspects of the invention, by a showcase according to the disclosure, as well as by a beam according to the disclosure, as well as by a method according to the disclosure.

More specifically, in accordance with the first aspect of the invention, the display showcase comprises:

- a base,
- fixed side walls, supported by the base,
- at least one openable side wall,
- an upper horizontal beam, mounted at the openable side wall,
- an upper ceiling, mounted on the fixed side walls and on the beam, wherein the beam comprises:

- a longitudinal tubular element,
- two head groups, abutted at opposite ends of the tubular element,
- a tie rod, longitudinally extended in the tubular element, in a lower region thereof, coupled to the two head groups and taut therebetween.

The tie rod, thanks to the fact that it is arranged in the lower region of the beam, is put under traction due to the weight of the ceiling; with a suitable pretensioning, it is possible to ensure that the beam is perfectly flat under the weight of the ceiling, even with an extremely limited bulk in height.

Preferably, the beam also comprises:

- two thrust blocks, integrally fixed to the tie rod, proximate to the ends of the tie rod but spaced from the head groups,
- a strut in the tubular element, extended above the tie rod in an upper region of the tubular element, abutted against the thrust blocks and compressed therebetween.

The strut can be precompressed (preloaded under compression), so as to contribute to the tensioning of the tie rod. Moreover, its presence inside the tubular element, above the tie rod, ensures that the tie rod remains in its foreseen position, avoiding risks of instability. Indeed, in the case in which the pretensioning of the tie rod is insufficient with respect to the weight of the ceiling, a possibly curving downwards of the beam could make the tie rod snap in the upper region of the tubular body, suddenly compromising the capacity of supporting the ceiling.

Preferably, again to avoid possible risks of instability, in the absence of the strut or in addition to it, in the tubular element there are one or more spacers, which keep the tie rod in the lower region of the tubular element.

Preferably, the beam comprises means for adjusting the tension of the tie rod, so as to allow to adequately adjust the pretensioning of the tie rod itself.

Preferably, the beam comprises means for adjusting the compression of the strut, so as to allow to adequately adjust the precompression of the strut itself.

More preferably, the aforementioned means for adjusting the tension of the tie rod and/or means for adjusting the compression of the strut are accessible even with the ceiling resting on the beam.

Preferably, the means for adjusting the tension of the tie rod comprise:

- a first threaded hole in the tie rod, formed longitudinally at a first of the ends of the tie rod,
- a first through hole, formed in a first of the head groups, at the first threaded hole,
- a first screw inserted in the first through hole and screwed into the first threaded hole, the first screw having its head abutted at the first head group.

With this simple configuration it is possible to precisely adjust the pretensioning of the tie rod; moreover, it is easy to ensure that the adjustment screw is accessible even when the ceiling is already on the beam, in such a way allowing the tension of the tie rod to be adjusted with the ceiling already supported, thus when the planarity of the beam is visually controllable.

Preferably, the means for adjusting the compression of the strut comprise:

- a first threaded hole in a first of the thrust blocks,
- a first screw screwed into the first threaded hole and abutted with its stem at a first end of the strut.

With this simple configuration it is possible to precisely adjust the precompression of the strut; moreover, it is easy to ensure that the adjustment screw is accessible even when the ceiling is already on the beam, in such a way allowing the compression of the strut to be adjusted with the ceiling already supported, thus when the planarity of the beam is visually controllable.

In accordance with the second aspect of the invention, a beam intended to be used in the construction of a display showcase for supporting a ceiling of the showcase comprises:

- a longitudinal tubular element,
- two head groups, abutted at opposite ends of the tubular element,
- a tie rod, longitudinally extended in the tubular element, in a lower region thereof, coupled with the two head groups and taut therebetween, wherein the tie rod is pretensioned.

Preferably, the tubular element is curved, with convexity facing upwards. The convexity and the pretensioning are such that the beam becomes perfectly flat, once subjected to the weight of the ceiling during the construction of the showcase.

In accordance with the third aspect of the invention, a method for making a display showcase comprises the steps of:

- providing a base,
- mounting fixed side walls on the base,
- mounting an upper horizontal supporting beam of a ceiling on the fixed side walls at an openable side wall,
- mounting the ceiling on the fixed side walls and on the beam,
- mounting the openable side wall, wherein the beam—before being mounted in the showcase—is subjected to the following step:

- pretensioning a lower region of the beam.

Preferably, the method also comprises the step of:

- deforming the beam by curving it, so as to have a concave lower side and a convex upper side.

Preferably, at the end of the step of mounting the ceiling, the beam subjected to the weight of the ceiling is substantially straight.

Preferably, the method comprises the steps of:

- providing a longitudinal tubular element,
- providing a longitudinal tie rod in the tubular element, in a lower region thereof,
- abutting two head groups at opposite ends of the tubular element,
- coupling the tie rod with the two head groups,
- pretensioning the tie rod.

Preferably, the step of providing the beam comprises the steps of:

- providing two thrust blocks integral with the tie rod, close to the ends of the tie rod but spaced from the head groups,
- providing a strut in the tubular element, extended above the tie rod in an upper region of the tubular element,
- abutting the strut at the thrust blocks,
- precompressing the strut.

Preferably, the step of providing the beam comprises the step of:

- arranging one or more spacers in the tubular element, said spacers keeping the tie rod in the lower region of the tubular element.

Preferably, the ceiling and at least one of the side walls are made from glass.

Further characteristics and advantages of the invention will become clearer from the following description of an embodiment thereof, made with reference to the attached drawings. In such drawings.

Figure 1:
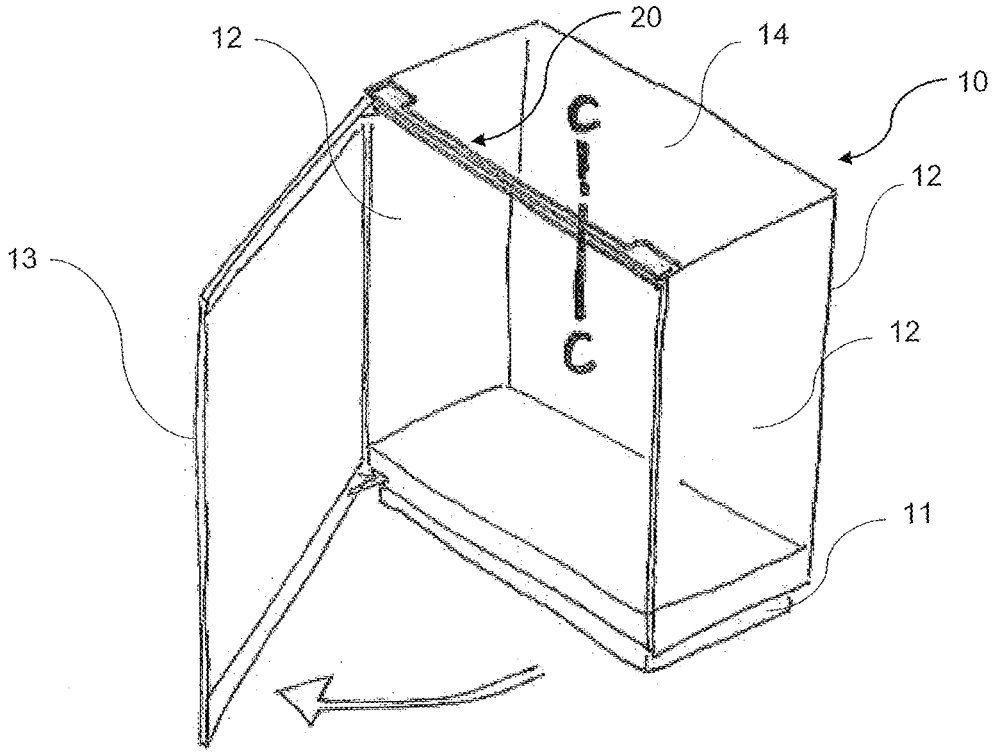
FIG. 1 is an overall view of a showcase according to the invention.
Figure 2:
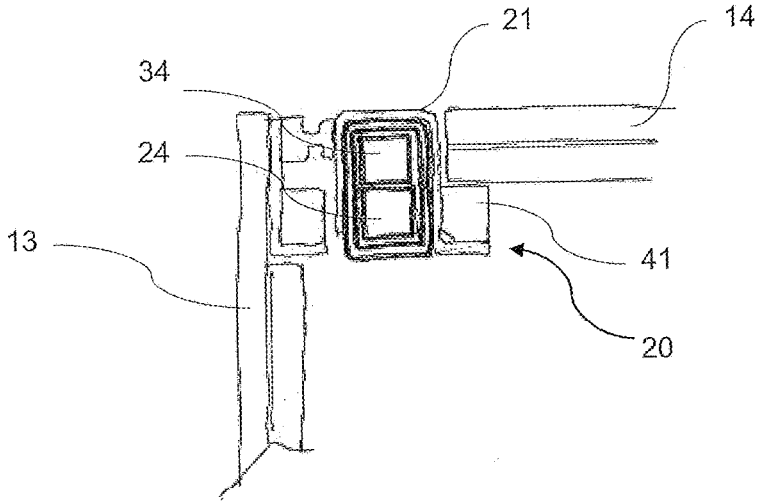
FIG. 2 is a cross section view of the upper portion of the showcase, according to the line C-C of FIG. 1.
Figure 3:
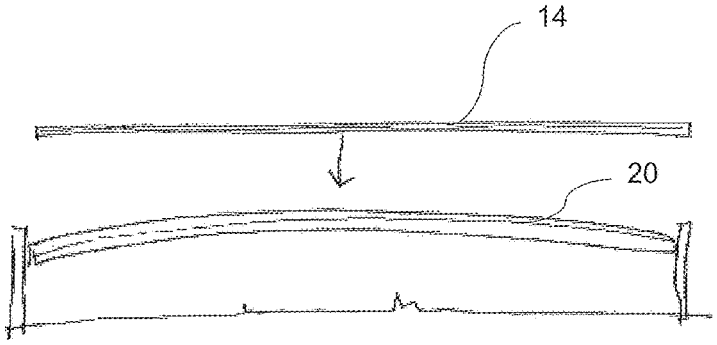
FIG. 3 is a schematic view of the beam of the showcase of FIG. 1, during the construction of the showcase of FIG. 1, before the ceiling of the showcase is rested on the beam.
Figure 4:
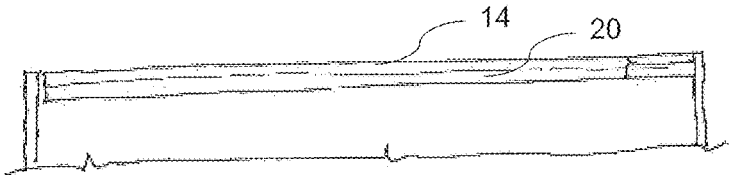
FIG. 4 is a schematic view of the beam of the showcase of FIG. 1, during the construction of the showcase of FIG. 1, after the ceiling of the showcase has been rested on the beam.
Figure 5:
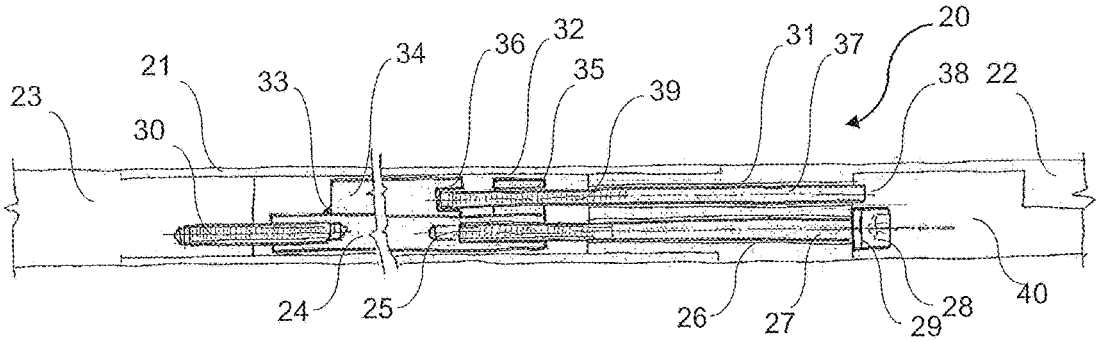
FIG. 5 is a partial longitudinal section view of the beam of FIG. 3, after the ceiling of the showcase has been rested on the beam.

In the figures, a display showcase 10 is shown, illustrated in a schematic and simplified manner, omitting many constructive details that are not relevant for the purposes of the present invention; such details that are not illustrated must be considered per se conventional, and within the capabilities of those skilled in the art. The illustrated shape of the showcase (parallelepiped) was also selected only for simplicity of representation but it is not in itself relevant or restrictive for the invention.

The showcase 10 comprises a base 11, on which fixed side walls 12, for example three fixed side walls 12, and at least one openable side wall 13 are mounted; the openable wall 13 is of the hinge-opening type (through hinging means that are not illustrated), but it could be of a type able to open differently, for example openable by sliding, translation, roto-translation, etc. Moreover, the showcase could have more than one openable side wall.

The showcase 10 also comprises an upper ceiling 14 (also called top), which goes over the fixed side walls 12 and the openable side wall 13. Moreover, the showcase 10 comprises closing means, not illustrated and not part of the invention, selected in a per se conventional way according to the closing requirements of the showcase 10.

In the illustrated showcase 10, the fixed side walls 12 and the openable side wall 13 are made from transparent material, in particular glass. The invention is not limited to showcases with glass walls, however it has particularly interesting application with these showcases, for the reasons that will be illustrated more clearly hereinafter.

The showcase 10 also comprises a horizontal upper beam 20, mounted on two opposite fixed side walls 12, at the openable side wall 13. The ceiling 14 is mounted on the fixed side walls 12 and on the beam 20, so that its weight bears down on them.

The beam 20 comprises a longitudinal tubular element 21 (i.e. extended in the direction of the length of the beam 20), at the opposite ends of which two head groups 22, 23 are abutted. The tubular element 21 has a substantially rectangular cross section, elongated in the height direction, so that a lower region and an upper region are defined in it.

The tubular element 21 has a tie rod 24 arranged in it, longitudinally extended in the lower region of the tubular element 21. The tie rod 24 is coupled with the two head groups 22, 23 and is taut therebetween (i.e. it is subject to a mainly traction force).

The beam 20 also comprises means for adjusting the tension of the tie rod 24, so as to allow to adjust the tension of the tie rod 24 itself. These means for adjusting the tension of the tie rod 24 comprise a threaded hole 25 in the tie rod 24, formed longitudinally at a first end of the tie rod 24, a through hole 26, formed in the first head group 22, at the threaded hole 25, and a screw 27 inserted in the through hole 26 and screwed into the threaded hole 25; the screw 27 has an enlarged head 28 abutted at the first head group 22, on the opposite side with respect to the tie rod 24, with interposition of a washer 29.

At the second end of the tie rod 24, there could be other means for adjusting the tension of the tie rod 24, analogous to the means 25-29 just described. Alternatively, like in the example of the showcase 10 illustrated, at the second end of the tie rod 24 there is a simple threaded tang 30, for coupling the tie rod 24 with the second head group 23. The threaded tang 30 provides an adjustable coupling, even if only when the beam 20 is not yet mounted on the showcase 10.

A strut 34 is also arranged in the tubular element 21, longitudinally extended in the upper region of the tubular element 21. The strut 34 is arranged between two thrust blocks 32, 33, integrally fixed to the tie rod 24, close to its ends but spaced from the head groups 22, 23 (i.e. not in contact with them); the strut 34 is compressed between the two thrust blocks 32, 33 (i.e. it is subject to a mainly compression force).

The beam 20 also comprises means for adjusting the compression of the strut 34, so as to allow to adjust the compression of the strut 34 itself. These means for adjusting the compression of the strut 34 comprise a threaded hole 35 in the first thrust block 32, a blind hole 36 formed at a first end of the strut 34 and a screw 37 with non-enlarged head 38, screwed into the threaded hole 35 and abutted with the end of its stem 39 in the blind hole 36; the screw 37 also passes through a hole 31 formed in the first head group 22. The first thrust block 32 is welded on the tie rod 24.

At the second end of the strut 34, there could be other means for adjusting the compression of the strut 34, analogous to the means 32-39 just described. Alternatively, like in the illustrated example of the showcase 10, at the second end of the strut 34 there is a simple weld between the strut 34 and the tie rod 24, a weld that constitutes the second thrust block 33.

Both the enlarged head 28 of the screw 27, and the non-enlarged head 38 of the screw 37, are accessible in a niche 40, formed in the first head group 22. The niche 40 is open towards the outside, so as to be accessible both when the beam 20 is not yet mounted in the showcase 10, and when the beam 20 is mounted in the showcase 10, in particular after the ceiling 14 has been placed over the fixed walls 12 and the beam 20.

The beam 20 is also provided with an edge 41, extended along the tubular body 21 and integral with it, on which the ceiling 14 is rested and fixed (typically by gluing).

According to an embodiment that is not illustrated, the beam 20 can also comprise one or more spacers of the tubular element 21, which hold the tie rod 24 in the lower region of the tubular element 21, preventing it from moving in the upper region.

The method according to which the showcase 10 is made provides that firstly the base 11 is arranged and that the fixed side walls 12 are mounted on it.

Separately, the beam 20 is arranged by pretensioning the lower region thereof. For this purpose, the enlarged head 28 of the screw 27 is acted upon so as to place the tie rod 24 under tension. The pretensioning is carried out until the tubular element 21 and—with it—the entire beam 20 are curved, with convexity facing upwards. Indeed, the unbalanced position of the tie rod 24, in the lower region of the section of the tubular element 21, ensures that the pretensioning of the tie rod 24 biases the tubular element 21 in an unbalanced manner, indeed such as to cause a deformation with the aforementioned curving.

In order to ease the same deformation, it is possible to act on the head 38 of the screw 37 so as to place the strut 34 under compression. Given the constraint between the strut 34 and the tie rod 24, a compression of the first is accompanied by a traction of the second, and therefore also the compression of the strut 34 tends to curve the tubular element 21 and with it the entire beam 20 upwards.

Possibly, before applying the aforementioned tensions of traction on the tie rod 24 and of compression on the strut 34, it is possible to deform the tubular element 21 so as to immediately give it an initial configuration with upward curving; in this way, the pretensioning of the tie rod 24 and the precompression of the strut 34 will require less force.

The aforementioned curving, pretensioning and precompression must clearly be adjusted as a function of the downward thrust of the ceiling 14, in turn determined by its weight, by its dimensions (length, width and thickness), by its deformability, by the width of the opening space of the openable side wall 13. With an adequate adjustment it will be possible to ensure that once the ceiling 14 has been applied on the edge 41 of the beam 20, the latter is arranged perfectly straight and horizontal, together with the ceiling 14 itself. This condition can be obtained with a suitable calculation of forces and deformations, but it will also be possible to obtain it with an empirical approach, exploiting the possibilities of adjustment offered by the beam 20, also with the ceiling 14 already arranged above the fixed side walls 12 and the beam 20: if once the ceiling 14 is placed there is still an upward curving, it will be necessary to reduce the tension of the tie rod 24 and/or the compression of the tie rod 34, by acting on the screws 27 and/or 37, and vice-versa. Of course, these adjustments must be made before the final fixing (typically through gluing) of the ceiling 14 to the fixed side walls 12 and to the beam 20, so that the ceiling 14 can be aligned correctly on the edge 41 of the beam 20.

Once the mounting of the ceiling 14 is complete, the showcase 10 is completed by mounting the openable wall 13. Thanks to the invention, the accuracy of the closing of the openable wall 13 is optimal, thanks to the perfect planarity of the beam 20.

It should be noted that this result is obtained with a beam 20 that has a minimum bulk in section, also in the vertical direction, such as not only to avoid disturbances to the visibility and to the exploitability of the works displayed in the showcase 10, but also to be in most cases substantially invisible. Indeed, the beam 20 according to the invention is thin enough to be hidden from view by the reflections and refractions in the glass of walls and ceiling, at the upper corners of the showcase 10.

For this reason, the invention is particularly valuable when the showcase 10 is made with walls and ceiling entirely from glass, particularly in the presence of one or more very large openable side walls.

The invention claimed is:

1. A display showcase, comprising:
- a base;
- fixed side walls, supported by the base;
- at least one openable side wall;
- an upper horizontal beam, mounted at the openable side wall; and
- an upper ceiling, mounted on the fixed side walls and on the beam,
  - wherein the beam comprises:
    - a longitudinal tubular element,
    - two head groups, abutted at opposite ends of the tubular element,
    - a tie rod, longitudinally extended in the tubular element, in a lower region thereof, coupled to the two head groups and taut therebetween,
    - two thrust blocks, integrally fixed to the tie rod, proximate to the ends of the tie rod but spaced from the head groups, and
    - a strut in the tubular element, extended above the tie rod in an upper region of the tubular element, abutted against the thrust blocks and compressed therebetween.

2. The showcase according to claim 1, wherein the beam comprises means for adjusting the tension of the tie rod.

3. The showcase according to claim 1, wherein the beam comprises means for adjusting the compression of the strut.

4. The showcase according to claim 1, wherein the ceiling and at least one of the side walls are made of glass.

5. A beam intended to be used in the construction of a display showcase for supporting a ceiling of the showcase, comprising:
- a longitudinal tubular element;
- two head groups, abutted at opposite ends of the tubular element; and
- a tie rod, longitudinally extended in the tubular element, in a lower region thereof, coupled to the two head groups and taut therebetween,
  - wherein the tie rod is pretensioned, and
  - wherein the tubular element is curved, with convexity facing upwards.

6. A method for manufacturing a display showcase, comprising the steps of:
- arranging a base;
- mounting fixed side walls on the base;
- mounting on the fixed side walls an upper horizontal beam for supporting a ceiling at an openable side wall;
- mounting the ceiling on the fixed side walls and on the beam; and
- mounting the openable side wall;
  - wherein the beam, before being mounted in the showcase, is subjected to the following step:
    - pretensioning a lower region of the beam.

7. The method according to claim 6, further comprising the step of:
- deforming the beam by bending it, so that it has a concave lower side and a convex upper side.

8. The method according to claim 6 wherein, at the end of the ceiling mounting step, the beam subjected to the weight of the ceiling is substantially straight.

* * * * *